US009831011B2

(12) United States Patent
Ohgushi et al.

(10) Patent No.: US 9,831,011 B2
(45) Date of Patent: Nov. 28, 2017

(54) CABLE AND METHOD FOR MANUFACTURING THE SAME

(71) Applicant: YAZAKI CORPORATION, Minato-ku, Tokyo (JP)

(72) Inventors: Kazuhiro Ohgushi, Susono (JP); Satoru Yoshinaga, Susono (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 787 days.

(21) Appl. No.: 14/037,748

(22) Filed: Sep. 26, 2013

(65) Prior Publication Data

US 2014/0090868 A1 Apr. 3, 2014

(30) Foreign Application Priority Data

Oct. 1, 2012 (JP) ..... 2012-219150

(51) Int. Cl.
*H01B 3/30* (2006.01)
*H01B 7/00* (2006.01)
(Continued)

(52) U.S. Cl.
CPC ..... *H01B 7/0081* (2013.01); *H01B 7/0275* (2013.01); *H01B 13/14* (2013.01); *H01B 13/148* (2013.01)

(58) Field of Classification Search
CPC .. H01B 7/0081; H01B 7/0275; H01B 13/148; H01B 13/14
(Continued)

(56) References Cited

U.S. PATENT DOCUMENTS 3,749,817 A * 7/1973 Shiga ..... H01B 3/441 174/102 SC
3,836,695 A * 9/1974 Strecker ..... H01B 3/307 156/48
(Continued)

FOREIGN PATENT DOCUMENTS

JP 56126207 A 10/1981
JP 2004-253228 9/2004
JP 2008-41801 2/2008

OTHER PUBLICATIONS

Communication dated May 10, 2016, from the Japanese Patent Office in counterpart application No. 2012-219150.
(Continued)

*Primary Examiner* — Sherman Ng
(74) *Attorney, Agent, or Firm* — Sughrue Mion, PLLC

(57) ABSTRACT

A cable includes: a conductor including strands densely arranged, the strands including out most strands located at outermost parts of the conductor and inner side strand located on inner side of the outermost strands; and an insulation covering that covers the periphery of the conductor. The insulation covering is in surface contact with the outermost strands, and is provided in a manner such that gaps are provided between the insulation covering and the inner side strands. In the method for manufacturing the cable, a fluid resin having a viscosity of greater than or equal to 323.6 Pa·sec at the point of extrusion is used, and the extrusion pressure of the resin is adjusted in a manner such that the insulation covering is in surface contact with the outermost strands and such that gaps are provided between the insulation covering and the inner side strands.

7 Claims, 7 Drawing Sheets

(51) Int. Cl.
*H01B 13/14* (2006.01)
*H01B 7/02* (2006.01)

(58) Field of Classification Search
USPC ..... 174/110 R, 113 R
See application file for complete search history.

(56) References Cited

U.S. PATENT DOCUMENTS 4,680,229 A * 7/1987 Betts ..... H01B 3/441 174/110 PM
5,841,073 A * 11/1998 Randa ..... H01B 7/295 174/113 R
2006/0131050 A1* 6/2006 Mhetar ..... H01B 3/441 174/110 R
2010/0212933 A1* 8/2010 Hayashishita ..... H01B 11/1895 174/113 C
2012/0145433 A1* 6/2012 Suzuki ..... C08L 23/04 174/110 SR
2012/0175146 A1* 7/2012 Oka ..... H01B 7/225 174/120 R
2012/0261158 A1* 10/2012 Daniel ..... B29C 70/523 174/102 A
2013/0327557 A1* 12/2013 Kumada ..... H01B 7/04 174/110 R

OTHER PUBLICATIONS

Communication dated Jul. 26, 2016, from the Japanese Patent Office in counterpart Japanese application No. 2012-219150.
Communication dated Aug. 8, 2016, from the European Patent Office in counterpart European application No. 13186619.6.
"Elastic Properties and Young Modulus for some Materials: Young Modulus (Tensile Modulus) for common materials—steel, glass, wood and more", The Engineering Toolbox, http://www.engineeringtoolbox.com, Apr. 23-Jun. 19, 2016, 3 pages.
Communication dated Aug. 11, 2017 from the European Patent Office in counterpart Application No. 13 186 619.6.

* cited by examiner

FIG. 5
| EXTRUSION PRESSURE OF POLYPROPYLENE MATERIAL | ADHESIVE FORCE [N] (INSULATION COVERING LENGTH: 30 mm) |
|---|---|
| SMALL | 18 |
| MEDIUM | 23 |
| LARGE | 26 |
FIG. 6A
PRIOR ART
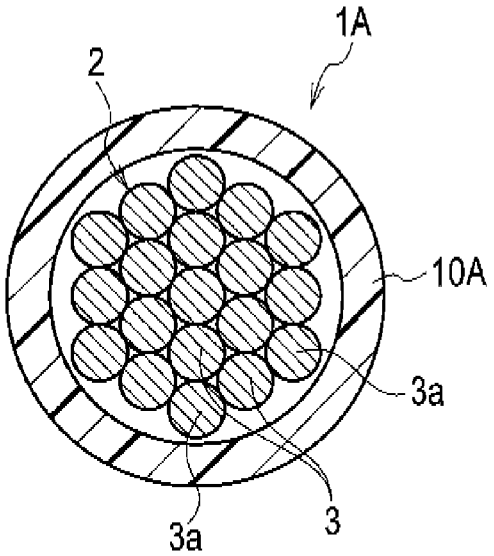
FIG. 6B
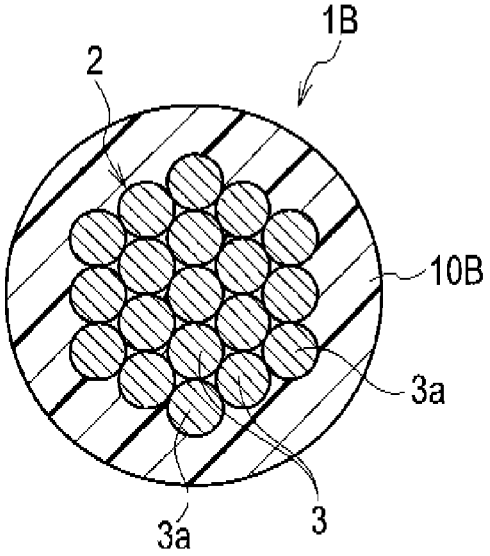

FIG. 7

| PRODUCT NAME | | | – | EMBODIMENT (FIG.3B) | CONVENTIONAL EXAMPLE (FIG.6A) |
|---|---|---|---|---|---|
| CONDUCTOR CONFIGURATION | | | mm/NUMBER | 0.08/19 | 0.08/19 |
| INSULATOR | MATERIAL | | – | PP | PVC |
| | EXTRUSION METHOD | | | SOLID EXTRUSION | TUBE EXTRUSION |
| | AVERAGE THICKNESS | Ave. | mm | 0.233 | 0.205 |
| | FINISHED OUTER DIAMETER | Ave. | mm | 0.883 | 0.866 |
| 180-DEGREE BENDING TEST | $\phi$=25mm | Ave. | NUMBER OF TIMES | 116,813 | 160,173 |
| ADHESIVE FORCE | | Ave. | N | 18 (INSULATION COVERING LENGTH: 30mm) | 6 (INSULATION COVERING LENGTH: 50mm) |
| BUCKLING LOAD | GAUGE LENGTH 15 mm | Ave. | N | 10.26 | 3.21 |

| | |
|---|---|
| STRAND DIAMETER (mm) | 0.08 |
| SECOND MOMENT OF AREA OF STRAND ($m^4$) | 2.0E-18 |
| BUCKLING LOAD PER STRAND (N) | 0.04 |
| BUCKLING LOAD OF CONDUCTOR (N) | 0.67 |
| OUTER DIAMETER OF TWISTED CONDUCTOR (mm) | 0.4 |
| FINISHED OUTER DIAMETER OF CABLE (mm) | 0.88 |
| SECOND MOMENT OF AREA OF INSULATION COVERING ($m^4$) | 2.8E-14 |
| CABLE LENGTH (mm) | 15 |
| MODULUS OF LONGITUDINAL ELASTICITY OF CONDUCTOR (GPa) | 100 |

CABLE AND METHOD FOR MANUFACTURING THE SAME

BACKGROUND OF THE INVENTION

1. Field of the Invention

The present invention relates to a cable having high resistance to bending, and a method for manufacturing the cable.

2. Description of the Related Art

As a conventional example, JP 2004-253228 A (Patent Literature 1) discloses a cable. A cable 50 as a first conventional example includes, as illustrated in FIG. 1, a conductor 51 in which a plurality of strands 51*a* are twisted, and an insulation covering 52 that covers the periphery of the conductor 51. A gap d is provided between the conductor 51 and the insulation covering 52. The insulation covering 52 is formed by extrusion in a manner as to have an inner diameter larger than the outline of the conductor 51. Namely, the insulation covering 52 is formed by tube extrusion.

The cable 50 of the first conventional example has high resistance to bending because a frictional force between the conductor 51 and the insulation covering 52 at the point of bending is small.

Patent Literature 1 also discloses, as illustrated in FIGS. 2A and 2B, a cable 60 as a second conventional example in which a plurality of linear parts 53 are interposed in a gap d between a conductor 51 and an insulation covering 52. Each of the linear part 53 is in point contact with the inner surface of the insulation covering 52. The insulation covering 52 is also formed by tube extrusion.

The cable 60 of the second conventional example also has high resistance to bending as in the case of the cable 50 of the first conventional example.

SUMMARY OF THE INVENTION

Each of the cables 50 and 60 of the respective conventional examples is provided with the gap d between the conductor 51 and the insulation covering 52. Therefore, an adhesive force between the conductor 51 and the insulation covering 52 is significantly decreased, compared with a cable formed in a manner such that the insulation covering 52 is inserted between the strands 51*a* of the conductor 51 (by solid extrusion molding). Thus, there is a problem of workability at the point of an operation in which a strong pull force is applied to the insulation covering 52, in particular, at the point of cutting or sheath peeling of the cables 50 and 60.

The present invention has been made in view of the above-described conventional problem. It is an object of the present invention to provide a cable capable of ensuring both resistance to bending and workability to the extent possible, and to provide a method for manufacturing the cable.

A cable according to a first aspect of the present invention includes: a conductor including a plurality of strands densely arranged, the strands including out most strands located at outermost parts of the conductor and inner side strand located on inner side of the outermost strands; and an insulation covering that covers the periphery of the conductor. The insulation covering is in surface contact with the outermost strands, and is provided in a manner such that gaps are provided between the insulation covering and the inner side strands.

The insulation covering is preferably made from an insulation resin material having a longitudinal elastic modulus of greater than or equal to 1150 MPa.

A method for manufacturing a cable according to a second aspect of the present invention includes: forming an insulation covering on a periphery of a conductor by extruding a molten insulation resin material, on the periphery of the conductor, the conductor including a plurality of strands densely arranged, the strands including out most strands located at outermost parts of the conductor and inner side strand located on inner side of the outermost strands; using, as the molten insulation resin material, a fluid resin material having a viscosity of greater than or equal to 323.6 Pa·sec at the point of extrusion; and adjusting a pressure when the molten insulation resin material is extruded in a manner such that the insulation covering is in surface contact with the outermost strands and such that gaps are provided between the insulation covering and the inner side.

According to the cable of the first aspect of the present invention, the inner side strands are free from the insulation covering so as to be movable therein, since the gaps are provided between the insulation covering and the inner side strands. Therefore, the cable can ensure good resistance to bending with no significant decrease. In the cable of the first aspect of the present invention, the insulation covering is provided by extrusion in a manner as to be in surface contact with peripheries of the outermost strands, so that a friction force between the conductor and the insulation covering greatly increases. Accordingly, the cable can have good workability. Consequently, the cable can ensure both resistance to bending and workability to the extent possible.

BRIEF DESCRIPTION OF THE DRAWINGS

FIG. 5 is a table of an adhesive force of an cable made from a polypropylene material formed at each extrusion pressure.

FIG. 6A is a cross-sectional view of an cable formed by tube extrusion (conventional example), and FIG. 6B is a cross-sectional view of a cable formed by solid extrusion molding.

FIG. 7 is a table of specifications of the cable according to the embodiment and the cable according to the conventional example (the cable formed by tube extrusion), and each measurement result of a bending test, an adhesive force, and a buckling load.

DESCRIPTION OF THE EMBODIMENTS

An embodiment will be explained with reference to the drawings.

Figure 1:
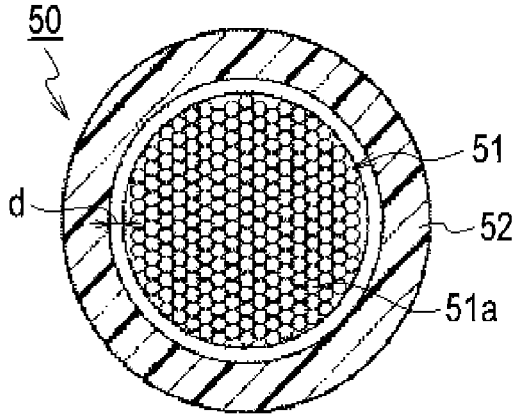
FIG. 1 PRIOR ART
FIG. 1 is a cross-sectional view of a cable of a first conventional example.
Figure 2A:
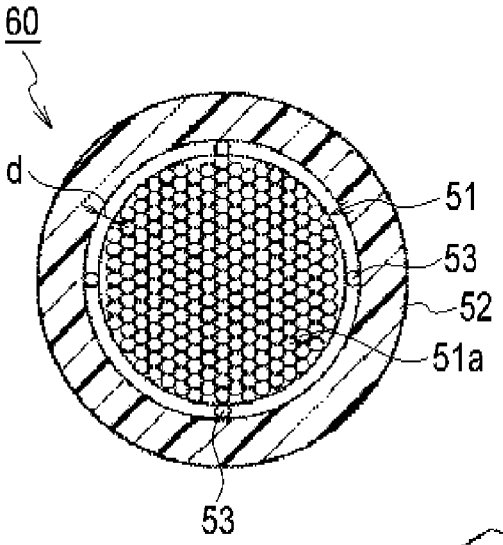
FIG. 2A PRIOR ART
FIG. 2A is a cross-sectional view of a cable of a second conventional example.
Figure 2B:
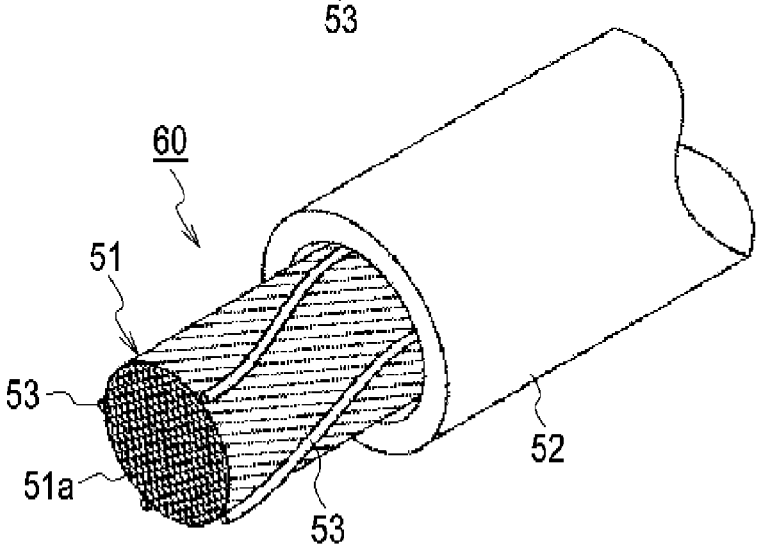
FIG. 2B PRIOR ART
FIG. 2B is a perspective view of the cable of the second conventional example.
Figure 3A:
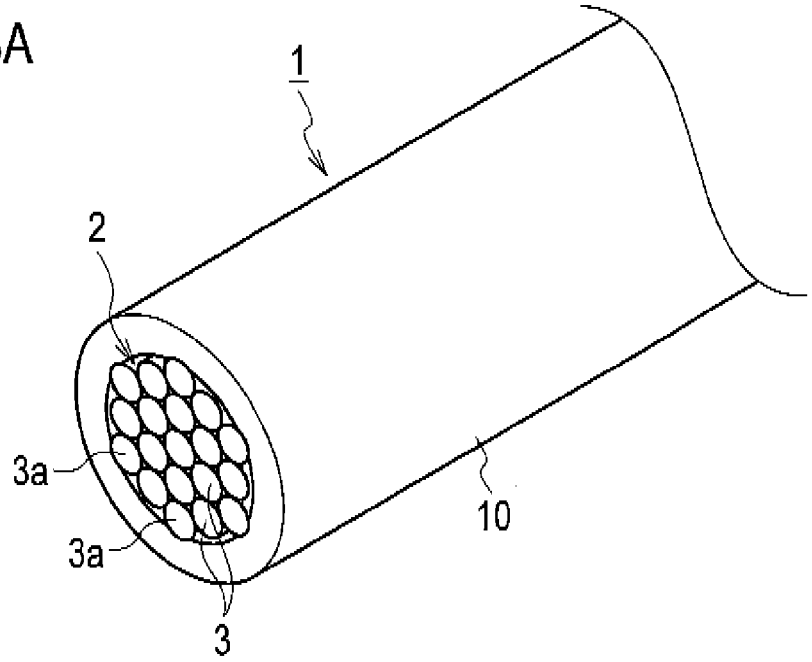
FIG. 3A is a perspective view of a cable according to an embodiment.
Figure 3B:
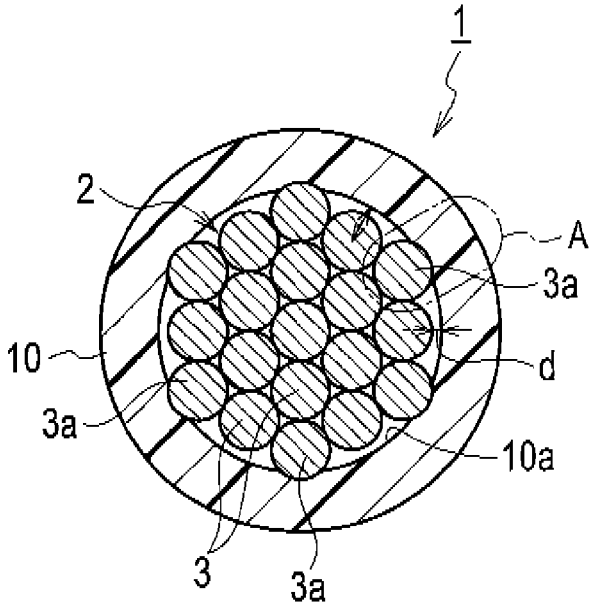
FIG. 3B is a cross-sectional view of the cable according to the embodiment.

As illustrated in FIGS. 3A and 3B, a cable 1 according to an embodiment includes a conductor 2 and an insulation covering 10 that covers the periphery of the conductor 2. The conductor 2 includes a plurality of strands 3, 3*a* that are twisted and densely arranged. The strands 3, 3*a* include out most strands 3*a* located at outermost parts of the conductor 2, and inner side strand 3 located on the inner side of the outermost strands 3*a*. The strands 3, 3*a* axe made of electrically conductive metal such as a copper alloy or aluminum.

Figure 3C:
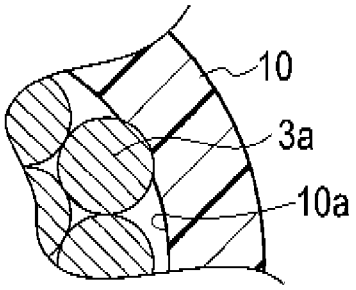
FIG. 3C is an enlarged view of area A in FIG. 3B.

As illustrated in FIGS. 3B and 3C, the insulation covering 10 is in surface contact with the outermost strands 3*a*, and gaps d are provided between the insulation covering 10 and the inner side strands 3. Here, the outermost strands 3*a* represent strands in contact with a circumscribed circle that is concentric with the cross section of the conductor 2 and is in contact with the periphery of the conductor 2, and the inner side strands 3 represent strands not in contact with the circumscribed circle. The inner surface 10*a* of the insulation covering 10 is formed into an arc-like shape along the periphery of the conductor 2 and in contact with the periphery of each of the outermost strands 3*a*.

The insulation covering 10 is made from a polypropylene material that is an insulation resin material. The insulation covering 10 is formed in a manner such that the polypropylene material is provided by extrusion molding on the periphery of the conductor 2.

Figure 4:
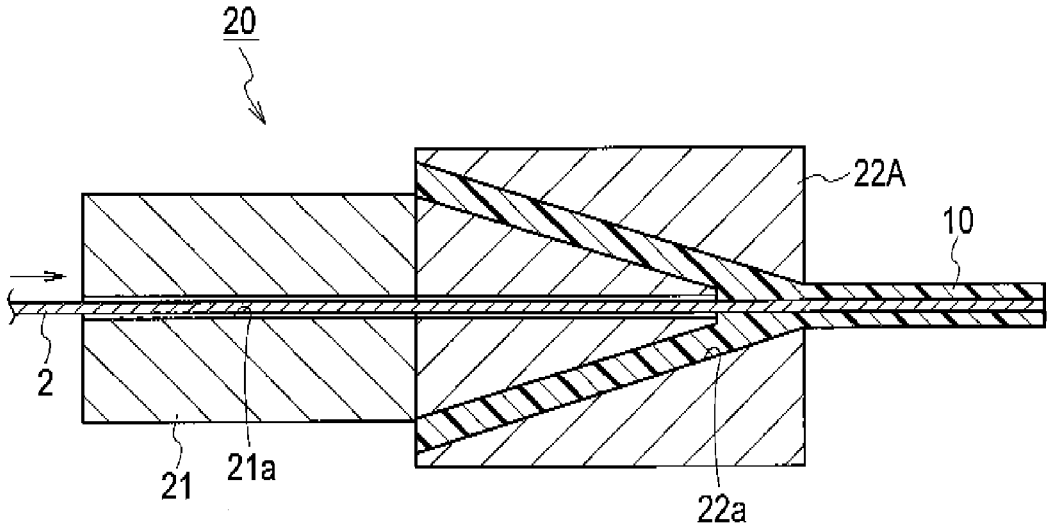
FIG. 4 is a cross-sectional view of a main part of an extrusion forming device for forming an insulation covering.

As illustrated in FIG. 4, an extrusion molding device 20 includes a core metal 21 having a conductor insertion hole 21 a into which the conductor 2 is inserted, and a mouthpiece 22A attached to the front end of the core metal 21. The mouth piece 22A communicates with the conductor insertion hole 21*a* and has a resin application hole 22*a*. The resin application hole 22*a* is a straight hole inclined toward an exit.

The insulation resin material of the insulation covering 10 is the polypropylene material. In the embodiment, the polypropylene material is extruded at the temperature of approximately 240° C., the shear rate of 1216 $sec^{-1}$, and the viscosity of 3216 Pa·sec. When the viscosity of the polypropylene material is less than 323.6 Pa·sec, the polypropylene material is inserted between the inner side strands 3 and the outermost strands 3*a* regardless of the extrusion pressure of the polypropylene material. As a result, an insulation covering 10B formed by solid extrusion molding (refer to FIG. 6B) is provided. If the viscosity of the polypropylene material is much greater than 323.6 Pa·sec, extrusion molding tends to be difficult When the viscosity of the polypropylene material is slightly greater than or equal to 323.6 Pa·sec, the insulation covering 10 formed by solid extrusion molding as illustrated in FIGS. 3A to3C may be provided depending on the extrusion pressure of the polypropylene material.

Namely, the extrusion pressure of the polypropylene material is adjusted in a manner such that the polypropylene material is in surface contact with the outermost strands 3*a*, and in a manner such that the gaps d are provided between the polypropylene material and the inner side strands 3.

The polypropylene material of which extrusion pressure was set to a large or medium level resulted in the cable 1B formed by solid extrusion molding in which the resin was also inserted into gaps between the inner side strands 3 and the outermost strands 3*a*, as illustrated in FIG. 6B. The polypropylene material of which extrusion pressure was set to a small level could provide the cable 1 (the present embodiment) formed by solid extrusion molding in which the resin was not inserted into the gaps between the inner side strands 3 and the outermost strands 3*a*, as illustrated in FIG. 3B. FIG. 5 illustrates each adhesive force of the cable 1 molded in a manner as to vary the extrusion pressure of the polypropylene material. As illustrated in FIG. 5, the cable 18 in which the insulation covering 10B is inserted into the gaps between the inner side strands 3 and the outermost strands 3*a* can ensure quite high adhesion between the conductor 2 and the insulation covering 10B. Even a cable in which the insulation covering 10 is not inserted into the gaps between the inner side strands 3 and the outermost strands 3*a* but is in contact with some of the inner side strands 3 and the outermost strands 3*a*, can ensure high adhesion between the conductor 2 and the insulation covering 10, compared with the cable 1A of the conventional example illustrated in FIG. 6A.

In the cable 1 according to the embodiment, the inner side strands 3 are free from the insulation covering 10 so as to be movable therein, since the gaps d are provided between the insulation covering 10 and the inner side strands 3. Therefore, good resistance to bending can be ensured with no significant decrease. Further, the insulation covering 10 is in surface contact with the outermost strands 3*a*, so that a friction force between the conductor 2 and the insulation covering 10 greatly increases. Therefore, good workability can be achieved. Consequently, the cable 1 according to the embodiment can ensure both resistance to bending and workability to the extent possible.

Figure 8A:
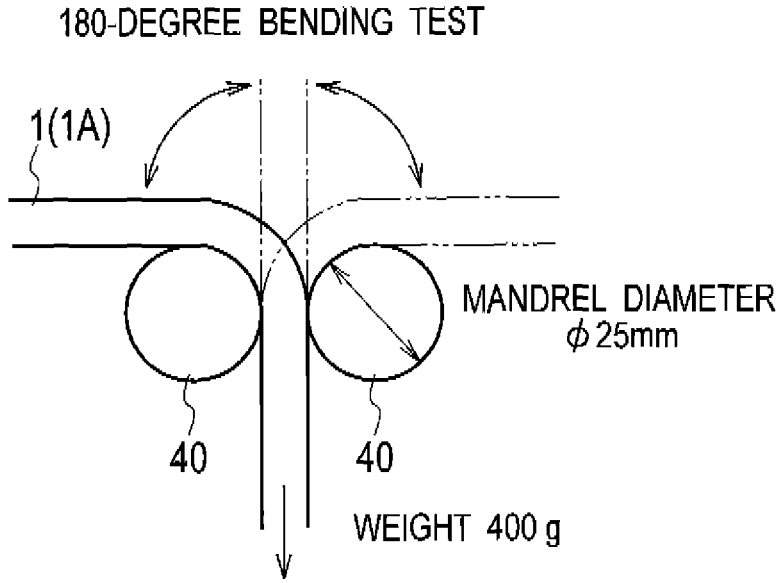
FIG. 8A is a schematic view for explaining the bending test.
Figure 8B:
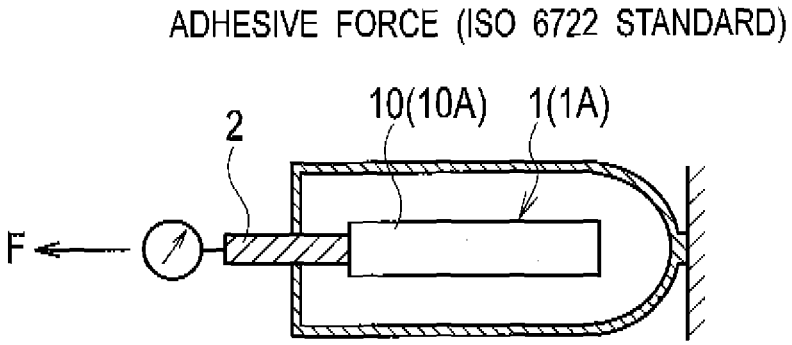
FIG. 8B is a schematic view when the adhesive force is measured.
Figure 8C:
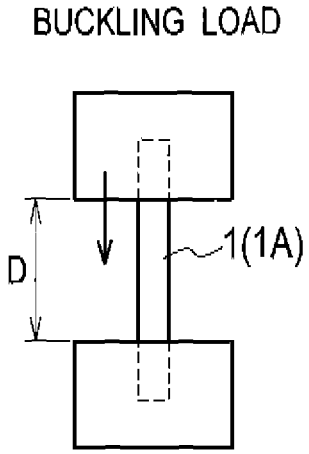
FIG. 8C is a schematic view when the buckling load is measured.

With regard to the cable 1A according to the conventional example illustrated in FIG. 6A and the cable 1 according to the embodiment illustrated in FIGS. 3A to 3C, a bending test was carried out, and an adhesive force value and a buckling load value were measured. As illustrated in FIG. 8A, the bending test was carried out in a manner such that the cable 1 according to the embodiment or the cable 1A of the conventional example was held between a pair of mandrels 40, and the cable 1 according to the embodiment or the cable 1A of the conventional example to which a predetermined load (400 g) was applied was repeatedly subjected to 180-degree swing operation, until the electric resistance increased by 10%, thereby counting the swing number of each cable. As illustrated in FIG. 8B, the adhesive force was measured in a manner such that one side of the insulation covering 10 of the cable 1 according to the embodiment and one side of the insulation covering 10A of the cable 10A of the conventional example each were fixed, and the conductor 2 on the other side of the cable 1 according to the embodiment and the conductor 2 on the other side of the cable 1A of the conventional example were then pulled, so as to detect the pull force (N) at the point when the conductor 2 of the cable 1 according to the embodiment and the conductor 2 of the cable 1A of the conventional example were pulled out of the insulation covering 10 and the insulation covering 10A, respectively. As illustrated in FIG. 8C, the buckling load was measured in a manner such that both sides of the cable 1 according to the embodiment and both sides of the cable 1A were fixed so as not to rotate, As illustrated in FIG. 7, the cable 1 according to the embodiment exhibited quite a good result with regard to the adhesive force, compared with the cable 1A of the conventional example. This is because, in the cable 1 according to the embodiment, the insulation covering 10 is in surface contact with the outermost strands 3*a* so that the friction force between the conductor 2 and the insulation covering 10 greatly increases. Therefore, the cable 1 according to the embodiment has good workability in the operation in which a strong pull force is applied to the insulation covering 10 (for example, at the point of cutting or sheath peeling of the cable). In particular, while an adhesive force required for processing with an automated machine is 10 N (the length of the insulation covering 10: 50 mm), the adhesive force of the cable 1 according to the embodiment greatly exceeded 10 N. The bending test revealed that the cable 1 according to the embodiment ensured good resistance to bending with no significant decrease, compared with the cable 1A of the conventional example. This is because, in the cable 1 according to the embodiment, the inner side strands 3 are free from the insulation covering 10 so as to be movable therein, since the gaps d are provided between the insulation covering 10 and the inner side strands 3. Consequently, the cable 1 according to the embodiment can ensure both resistance to bending and workability to the extent possible, The insulation covering 10 of the cable 1 according to the embodiment is made from a polypropylene (PP) material having a longitudinal elastic modulus E higher than that of a polyvinyl chloride (PVC) material. In the cable 1A of the conventional example, a polyvinyl chloride (PVC) material having a longitudinal elast modulus E of 442 MPa was used for the insulation covering 10A. In the cable 1 according to the embodiment, a polypropylene (PP) material having a longitudinal elastic modulus E of 1771 MPa was used for the insulation covering 10. As illustrated in FIG. 7, the buckling load of the cable 1 according to the embodiment was also improved because of the reason described below, compared with the cable 1A of the conventional example. A target value of the buckling load is greater than or equal to 7 N when a gauge length (D) is 15 mm. The cable 1 according to the embodiment achieved a good result that greatly exceeded the target value of 7 N as illustrated in FIG. 7.

Figures 9A, 9B:
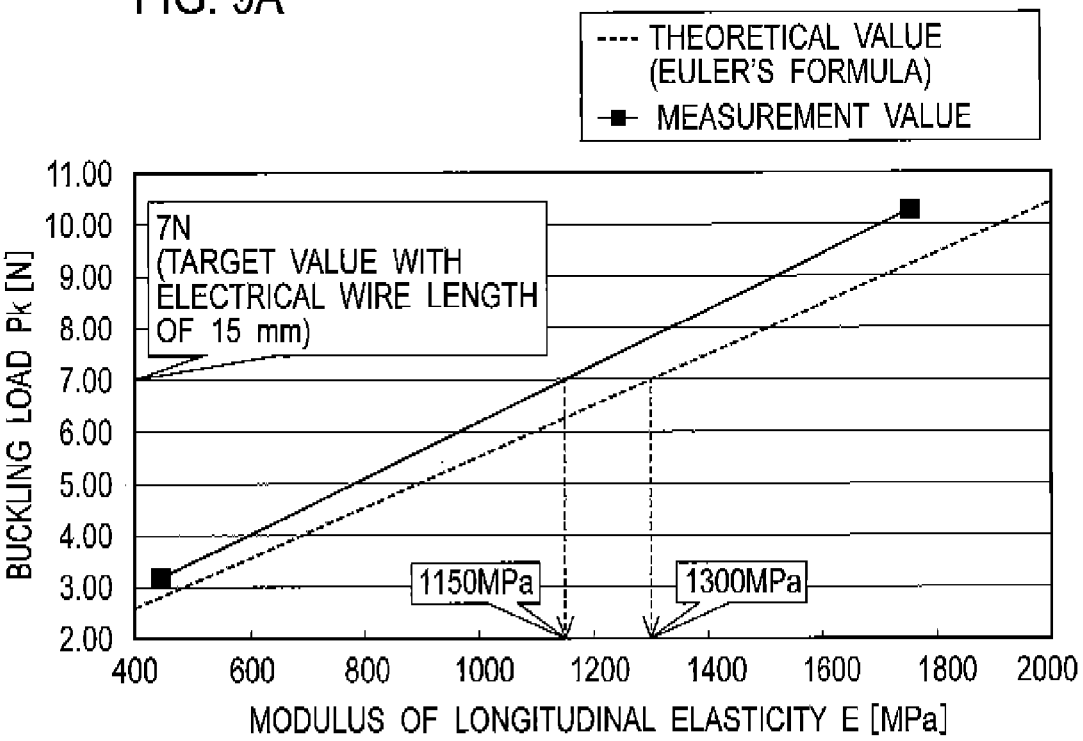
FIG. 9A is a characteristic diagram illustrating a longitudinal elastic modulus of the insulation covering and the buckling load of the cable.
FIG. 9B is a table of physical properties in each part of the cable.

FIG. 9A is a characteristic line diagram illustrating the longitudinal elastic modulus E of the insulation covering 10 and the buckling load in the cable 1 according to the embodiment (the physical properties in each part are illustrated in FIG. 9B). The characteristic lines represented by data theoretical values illustrated in FIG. 9A are obtained by use of the Euler's buckling formula $P_k=\pi^2\ (n\cdot E\cdot I/L^2)$, wherein $P_k$ is a buckling load, E is a longitudinal elastic modulus, I is a second moment of area, and L is a buckling length. Further, n is a coefficient determined according to the terminal condition on both sides, and n is four when both sides are fixed. As is apparent from FIG. 9A, the theoretical values are approximately identical to the measurement values and therefore, the buckling load of the cable 1 greatly depends on the longitudinal elastic modulus of the insulation covering 10. The insulation covering 10 can ensure the target buckling load (greater than or equal to 7 N with the gauge length (D) of 15 mm) when the insulation covering 10 is made from the insulation resin material having the longitudinal elastic modulus E of greater than or equal to 1150 MPa.

What is claimed is:

1. A cable, comprising:

a conductor comprising a plurality of strands densely arranged, the strands comprising out most strands located at outermost parts of the conductor and inner side strands located on inner side of the outermost strands; and an insulation covering that covers a periphery of the conductor, the insulation covering being in surface contact with the outermost strands, and being provided in a manner such that gaps are provided between the insulation covering and the inner side strands, the insulation covering formed such that an adhesive force of the insulation covering exceeds 10 N by adjusting a pressure that a fluid insulation resin material having a viscosity of approximately 323 Pa·sec and a range of the viscosity capable to provide the insulation covering being in surface contact with the outermost strands and being provided in a manner such that gaps are provided between the insulation covering and the inner side strands is extruded toward the periphery of the conductor.

2. The cable according to claim 1, wherein the insulation covering is made from an insulation resin material having a longitudinal elastic modulus of greater than or equal to 1150 MPa.

3. The cable according to claim 1, wherein the cable has an adhesive force strength greater than 0.2 N/mm.

4. The cable according to claim 1, wherein the fluid insulation resin material is extruded at a temperature of 240° C.

5. A method for manufacturing a cable, comprising:

forming an insulation covering on a periphery of a conductor by extruding a molten insulation resin material on the periphery of the conductor, the conductor comprising a plurality of strands densely arranged, the strands comprising out most strands located at outermost parts of the conductor and inner side strand located on inner side of the outermost strands;

using, as the molten insulation resin material, a fluid resin material having a viscosity of approximately 323 Pa·sec and a range of the viscosity capable to provide the insulation covering being in surface contact with the outermost strands and being provided in a manner such that gaps are provided between the insulation covering and the inner side strands when being extruded; and adjusting a pressure when the molten insulation resin material is extruded in a manner such that the insulation covering is in surface contact with the outermost strands and such that gaps are provided between the insulation covering and the inner side strands.

6. The method according to claim 5 further comprising:

producing an adhesive force of the insulation covering exceeding 0.2 N/mm by adjusting the pressure when the molten insulation resin material is extruded in the manner such that the insulation covering is in surface contact with the outermost strands and such that the gaps are provided between the insulation covering and the inner side strands.

7. A cable, comprising:

a conductor comprising a plurality of strands densely arranged, the strands comprising out most strands located at outermost parts of the conductor and inner side strands located on inner side of the outermost strands; and an insulation covering that covers a periphery of the conductor, the insulation covering being in surface contact with the outermost strands, and being provided in a manner such that gaps are provided between the insulation covering and the inner side strands, the insulation covering formed by adjusting a pressure that a fluid insulation resin material having a viscosity of greater than or equal to 323.6 Pa·sec and a range of the viscosity capable to provide the insulation covering being in surface contact with the outermost strands and being provided in a manner such that gaps are provided between the insulation covering and the inner side strands is extruded toward the periphery of the conductor, wherein the fluid insulation resin material is extruded at a temperature of 240° C.

* * * * *